US005596974A

United States Patent [19]

Hall et al.

[11] Patent Number: 5,596,974

[45] Date of Patent: Jan. 28, 1997

[54] CORONA GENERATOR SYSTEM FOR FUEL ENGINES

[75] Inventors: Richard Z. Hall, Arlington; Carl E. Gali, Garland, both of Tex.

[73] Assignee: LuLu Trust, Garland, Tex.

[21] Appl. No.: 546,891

[22] Filed: Oct. 23, 1995

[51] Int. Cl.[6] ..... F02P 3/02

[52] U.S. Cl. ..... 123/620

[58] Field of Search ..... 123/620, 594, 123/598, 605, 606, 607, 619, 628, 597, 596; 315/209 CD, 209 T; 361/207, 251, 253, 256, 257, 263

[56] References Cited

U.S. PATENT DOCUMENTS

| | | | |
|---|---|---|---|
| 3,408,536 | 10/1968 | Tibbs | 123/607 |
| 3,949,718 | 4/1976 | Turner | 123/620 |
| 4,245,609 | 1/1981 | Gerry | 123/594 |
| 4,269,160 | 5/1981 | Irvin, Jr. | 123/620 |
| 4,320,735 | 3/1982 | Canup | 123/607 |
| 4,446,826 | 5/1984 | Kimura et al. | 123/606 |
| 4,457,285 | 7/1984 | Hamai et al. | 123/598 |
| 4,502,454 | 3/1985 | Hamai et al. | 123/597 |
| 4,710,681 | 12/1987 | Zivkovich | 315/209 T |
| 5,207,208 | 5/1993 | Ward | 123/596 |
| 5,471,362 | 11/1995 | Gowan | 123/598 |
| 5,513,618 | 5/1996 | Rich et al. | 123/598 |

*Primary Examiner*—Raymond A. Nelli
*Attorney, Agent, or Firm*—John E. Vandigriff

[57] ABSTRACT

The invention is to a system in which a high voltage source is connected to and continuously supplies a RF voltage to each spark plug wire in an automotive ignition. The high voltage is capacitively connected by placing a metal clip on each spark plug wire and connecting the high voltage source to the metal clips. The metal clip and conductor in the spark plug wire forms the two plates for the capacitor and the insulating material on the spark plug wire is the dielectric of the capacitor. The application of the high voltage to the spark plug wire produces a continuous corona discharge at the tip of the spark plug internal to the engine. A corona discharge surface may also be on one surface of the engine head in the combustion chamber.

23 Claims, 5 Drawing Sheets

CORONA GENERATOR SYSTEM FOR FUEL ENGINES

FIELD OF THE INVENTION

The invention relates to automotive ignition systems, and more particularly to a continuous corona discharge system for producing a continuous corona discharge in the combustion chamber of a fuel engine.

BACKGROUND OF THE INVENTION

Various devices have been made to improve the fuel efficiency of automobiles and to decrease air pollution by the efficient burning of fuel. Improved combustion efficiency results in cleaner burning engines, more acceleration, and longer spark plug and engine life.

One such device is disclosed in U.S. Pat. No. 4,269,160, in which a capacitor-coupler devices is placed on each spark plug wire and then each of the capacitor-coupler devices is connected to the other devices by a set of parallel insulated wires. Current flowing in the spark plug wire by the firing cylinder induces an electrical potential in the capacitor-couplers on the spark plug wires of the non-firing cylinder. The electrical potential induced in the wire of the non-firing cylinder varies dependent upon the spark discharge current in the firing cylinder, and the frequency of the electrical potential depends upon the speed of the automobile engine.

Another similar devices is disclosed in U.S. Pat. No. 3,949,718. In this patent, a plurality of couplers are connected together by parallel wires, the couplers attached to each of the spark plug wires and the coil wire of an internal combustion engine ignition system. Each time the coil wire has a current flowing therein, a potential is coupled to each of the spark plug wires. The potential is dependent upon the current flow in the coil wire, and the frequency is dependent upon the speed of the automobile engine.

SUMMARY OF THE INVENTION

The invention is to a system in which a high voltage source is connected to and continuously supplies an RF voltage of each spark plug wire in an automotive ignition. The high voltage is capacitively connected by placing a metal clip on each spark plug wire and connecting the high voltage source to the metal clips. The metal clip and conductor in the spark plug wire forms the two plates for the capacitor and the insulating material on the spark plug wire is the dielectric of the capacitor. The application of the high voltage to the spark plug wire produces a continuous corona discharge at the tip of the spark plug internal to the engine. This corona enhances combustion efficiency through the production of ozone, electrolytes and other elements, and, when the spark plugs fires to ignite the gasoline, provides a more efficient burning of the gasoline vapor.

The high voltage source operates from the D.C. source voltage of the vehicle in which it is used. The output of the high voltage source has a continuous A.C. component magnetic wave with rise times in the medium to high RF range, up to about 50,000 volts, and is connected to each spark plug wire by a semicircular metal clip on the outside of the spark plug wire insulation to couple the high voltage through the spark plug wire to produce a corona discharge at the spark plug tip inside the engine.

The technical advance represented by the invention as well as the objects thereof will become apparent from the following description of a preferred embodiment of the invention when considered in conjunction with the accompanying drawings, and the novel features set forth in the appended claims.

DESCRIPTION OF A PREFERRED EMBODIMENT

Figure 1:
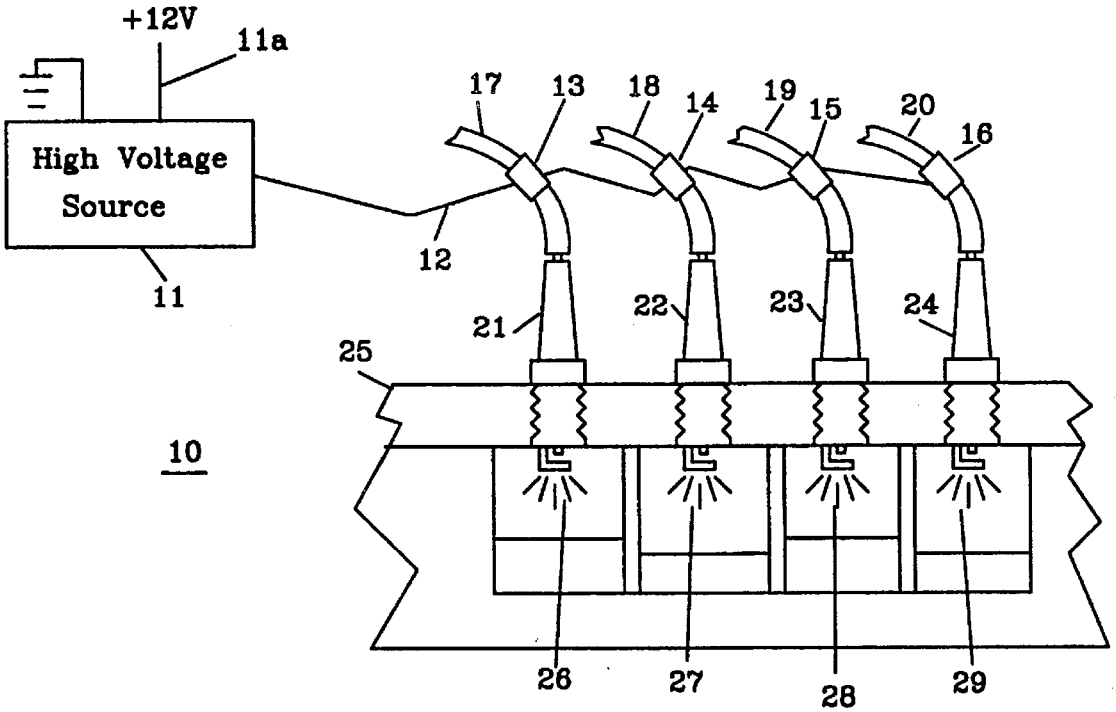
FIG. 1 shows a continuous corona discharge system according to the present invention.
Figure 3:
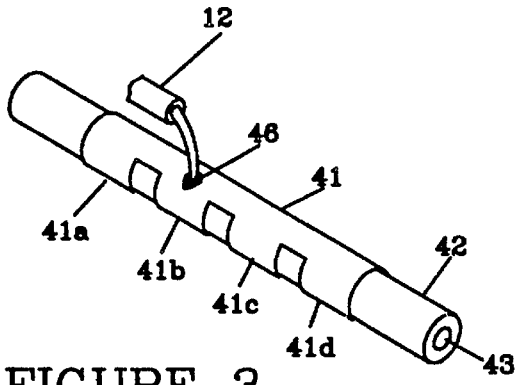
FIG. 3 shows a clip for attaching the RF voltage to a spark plug wire.

FIG. 1 shows a continuous corona discharge system 10 which includes a high voltage source 11 for generating an RF voltage. The continuous corona discharge system is applicable to engines having any number of spark plugs, but automotive engine 25 has four spark plugs 21–24 shown for purposes of illustration. To each spark plug is attached a spark plug wire. Spark plug 21 is connected to spark plug wire 17, spark plug 22 is connected to spark plug wire 18, spark plug 23 is connected to spark plug wire 19, and spark plug 24 is connected to spark plug wire 20. A metal clip, clips 13, 14, 15 and 16 are connected respectively to spark plug wires 17, 18,19 and 20. Each metal clip, shown in FIG. 3, is a spring clip that is attached to the spark plug wire over the wire insulation and is electrically insulated from the center conductor of the spark plug wire. Attached to each clip 13–16 is a conductive wire 12. Wire 12 connects each of clips 13–16 in parallel and to the high voltage, high frequency source 11.

When the automobile engine is started, switch 11*a* is closed supplying power to voltage source 12. A voltage in the range of 1 kv to 50 kv is output on conductor 12. The voltage can be less than 1 kv or greater than 50 kv, but for most application, the 1 kv to 50 kv is a suitable range. The frequency of the voltage is that frequency that will provide a continuous corona discharge 26–29 at the spark plug terminal within the engine. Frequencies up to 20,000 khz have been found suitable, but high frequencies may be used.

A limiting factor may be when a corona discharge is produced on conductor 12 or one of the clips 13–16 between the conductor or clips and another metallic object in the engine compartment. Also, the corona discharge is not to be of sufficient power to ignite fuel within the cylinder.

A distinction between the present invention is that in the present invention, a corona discharge (26–29)is continuously produce at the spark plug spark gap. In prior art systems, there is a corona discharge only when a spark is produced at a spark plug which induces a voltage at the other spark plugs. The corona discharge at one spark plug of the present invention is continuous while the engine is running and is independent of the corona discharge at other spark plugs.

Figure 2:
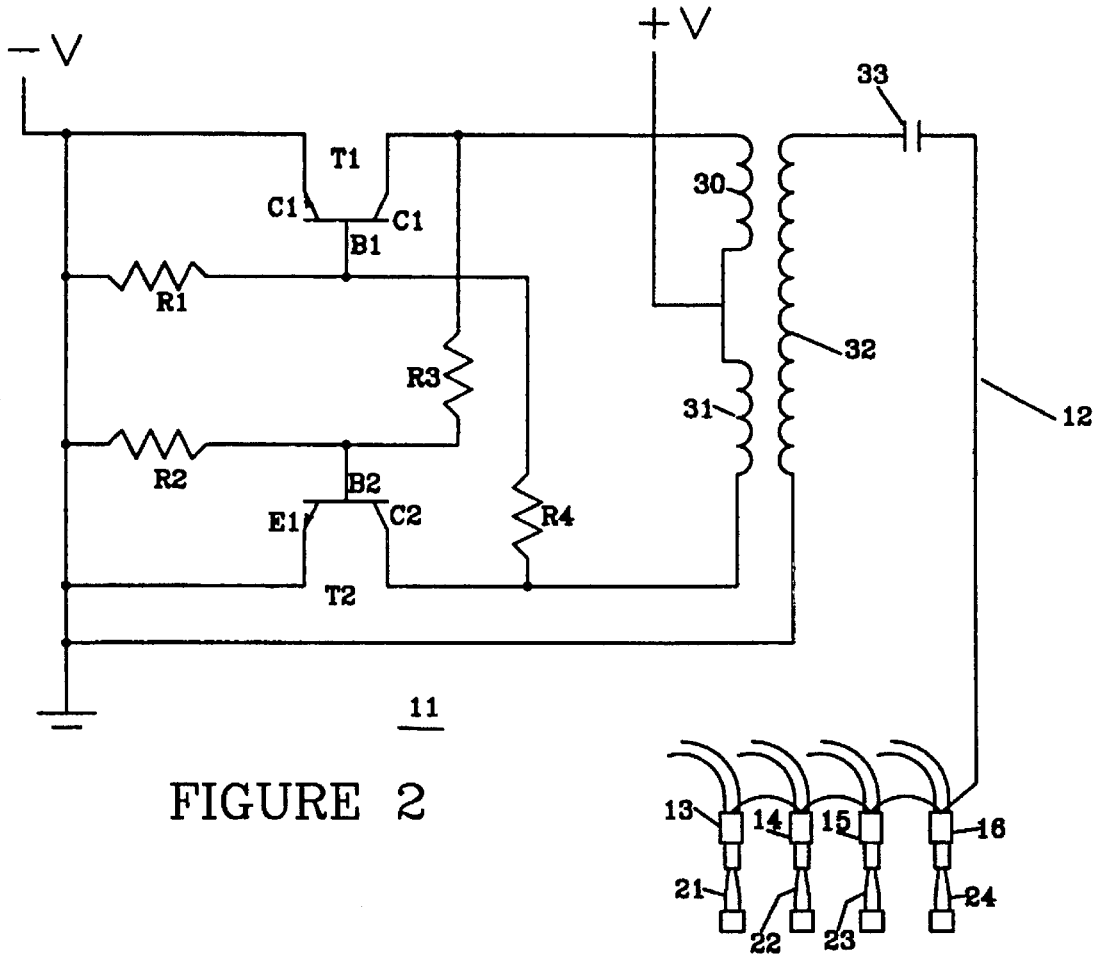
FIG. 2 shows one embodiment of a circuit for producing the RF voltage used in the corona discharge system.

FIG. 2 shows an embodiment of the RF voltage source. In this embodiment, a relaxation oscillator is made up of two transistors T1 and T2. The emitter, E1, E2 of each transistor is connected to ground, and the negative voltage terminal −V. Each collector C1 and C2, is connected to one end of split primary coils 30 and 31 of transformer Tr1. Base B2 is connected trough resistor R3 to collector C1 of transistor T1, and base B1 of transistor T1 is connected through resistor R4 to collector C2 or transistor T2. The common terminals of primary windings 30 and 31 are connected to a positive voltage +V. Any RF source may be used, and the source is not limited to the relaxation oscillator of FIG. 2.

The RF voltage is conducted from the high voltage source 11, through coupling capacitor 33, by conductor 12. Conductor 12 is connected to clips 13, 14, 15 and 16 which are fastened to spark plug wires 17–20, respectively.

FIG. 3 shows one embodiment of a coupler clip 41. Clip 41 is electrically connected to conductor 12 by any suitable means such as solder, a crimp terminal or screw. Clip 41 is clamped around a spark plug wire 42. In the example shown, clip 41 has several fingers 41*a*–41*d* that partially extend round wire 42. Fingers 41*a*–41*d* and the main part of the body of clip 41 form one plate of a capacitor. The other plate is conductor 43 inside of spark plug wire 42. The insulation material on wire 42 serves as the dialectic of the capacitor. The capacitor action of the spark plug wire 42 and clip 41 couples the RF energy onto conductor 43 providing the corona in the engine at the spark plug discharge point.

Figure 4:
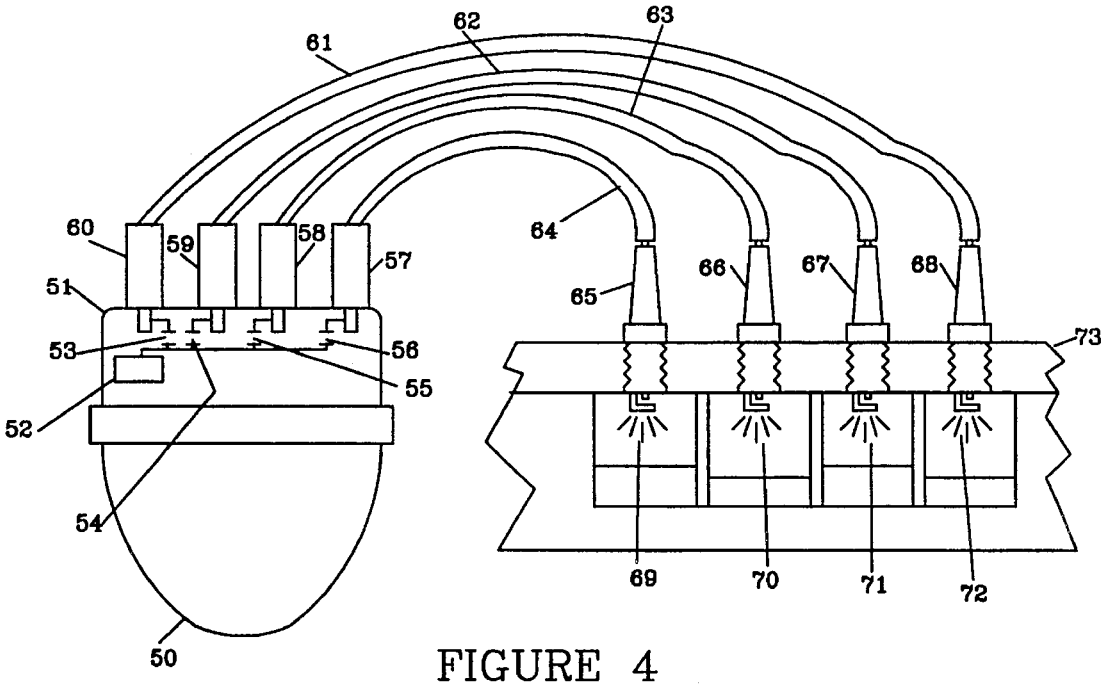
FIG. 4 is another embodiment of the invention where the RF source is in the distributor housing.

FIG. 4 is another embodiment of the invention in which a distributor 50 and distributor cap 51, pictorially illustrated, encloses an RF source 52. The RF voltage from RF source 52 is capacitor coupled by capacitors 53, 54, 55 and 64 to spark plug wire terminals 60, 59, 59 and 57, respectively. Spark plug wires 61–54 are connected to spark plug wires 65–68 as shown in FIG. 4. The RF voltage is carried along spark plug wires 61–64 to provide the constant corona discharges 69–72 on spark plugs 65–68, respectively. Capacitors 53–63 prevents the spark discharge from at one plug from also being on one of the other plugs, but the RF voltage is on all plugs at all times, being coupled through capacitors 53–56.

Figure 5:
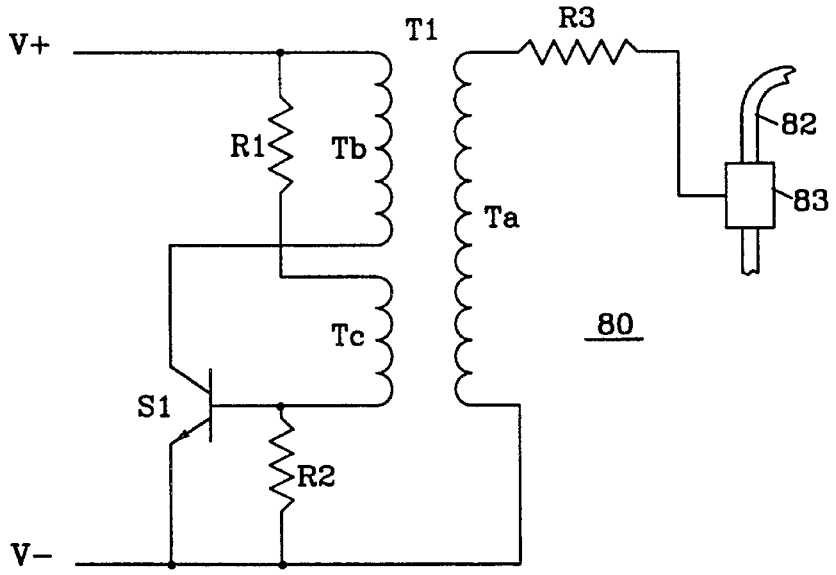
FIG. 5 illustrates a second embodiment of a circuit for producing an RF voltage.

FIG. 5 is a second embodiment of an example of an RF generator used to supply a high voltage to a spark plug wire to produce a corona. Circuit 80 is an oscillator circuit utilizing transistor $S_1$ connected to transformer $T_1$ which provides the feedback coupling for the oscillator circuit by coils $T_b$ and $T_c$, and coupling to the spark plug wire by coil $T_a$. Resistors $R_1$ and $R_2$ provide proper bias voltages to transistor $S_1$, and resistor $R_3$ along with winding $T_a$ provide the coupling to spark plug wire connection 83.

Figure 6:
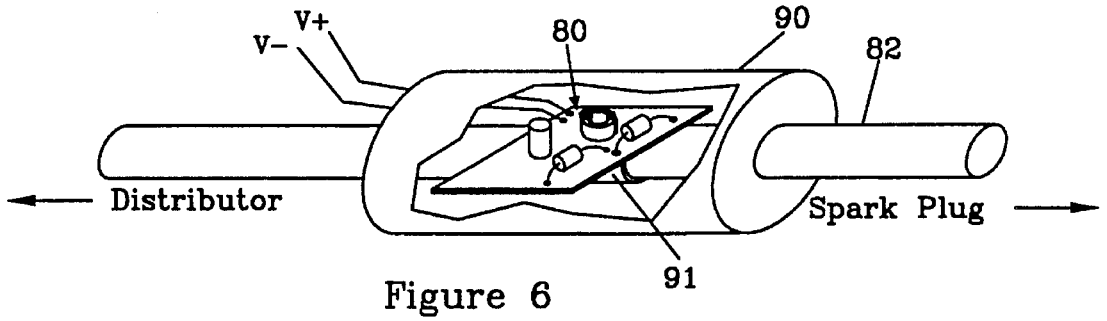
FIG. 6 shows a RF voltage module and coupler integrated with a spark plug wire.

FIG. 6 illustrates an embodiment of the invention in which the high voltage source is in modular form with one module integrated into the spark plug wire. High voltage source 80 is attached to a metal clip/coupler 91 which couples the high voltage to the spark plug wire. Supply voltage is applied at V+ and V−. The RF voltage source is encapsulated in a module through which the spark plug 82 wire passes. There is a RF module 80 integrated with each spark plug wire 82.

Figure 7:
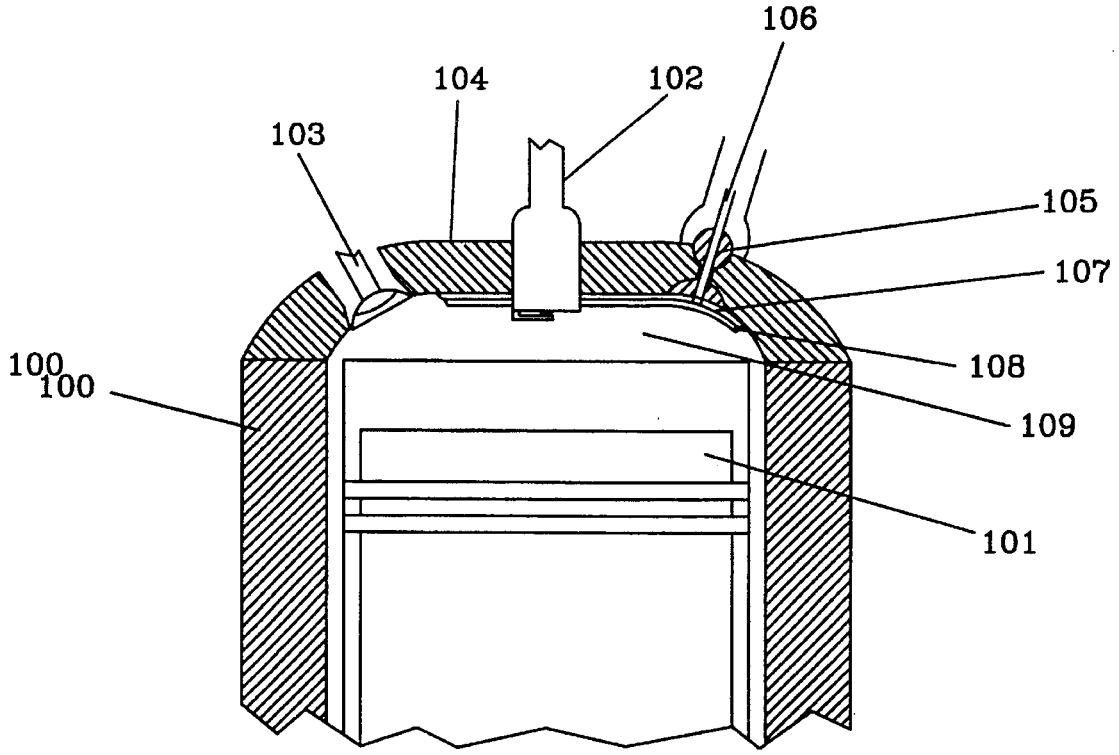
FIG. 7 illustrates a corona discharge surface in the engine combustion chamber.

FIG. 7 illustrates a corona chamber charge apparatus in the combustion chamber of an engine. For example, engine 100 has a piston 101 below the combustion chamber 109. The engine head 104 has an exhaust valve 103 and spark plug 102. Head 104 has a high voltage insulator 105 extending though head 104. Extending through insulator 105 is conductor 105 to which is applied the corona discharge voltage. Inside head 104 is a high voltage, high temperature insulating layer 107. On layer 107 is a metallic layer 108 to which is connected conductor 105. The insulating layer 107 and metallic layer 108 are placed over as much of the combustion chamber as possible to provide an even distribution of the corona within the combustion chamber prior to each ignition in the combustion chamber.

What is claimed:

1. A corona producing device for use in conjunction with an ignition system of a fuel engine to place a continuous corona in the combustion chamber at the tip of each spark plug of the engine; comprising:

a high voltage generator, independent of the ignition system, for producing a continuous AC voltage having frequency components in an RF range;

a coupler attached to each spark plug wire; and a single connecting wire between each coupler and the RF generator for producing a continuous corona at the tip of each spark plug.

2. The corona device according to claim 1, wherein the coupler forms a capacitive connection between the connecting wire and the spark plug wire.

3. The corona device according to claim 1, wherein the output of the high voltage generator has a continuous AC component magnetic wave with rise times capable of generating wave fronts in gases in the combustion chamber.

4. The corona device according to claim 1, wherein the RF generator provides a voltage output up to about 50 kv.

5. The corona device according to claim 1, wherein the corona device is housed in the distributor housing of the engine.

6. The corona device according to claim 1, wherein the corona at the tip of each spark plug is independent from the corona at the tip of any other spark plug of the engine.

7. A corona producing device for use in conjunction with an ignition system of a fuel engine to place a continuous corona at the tip of the each spark plug of the engine; comprising an RF signal source;

a capacitive coupler attached to each spark plug wire; and a single connecting wire between each coupler and the RF signal source for producing a continuous corona at the tip of each spark plug.

8. The corona device according to claim 7, wherein the coupler forms a single capacitive connection between the connecting wire and the spark plug wire.

9. The corona device according to claim 7, wherein the output of the high voltage generator has a continuous AC component magnetic wave with rise times capable of generating non-ignitable wave fronts in gases in the combustion chamber.

10. The corona device according to claim 7, wherein the RF generator provides a voltage output up to about 50 kv.

11. The corona device according to claim 7, wherein the corona device is housed in the distributor housing of the engine.

12. The corona device according to claim 7, wherein the corona at the tip of each spark plug is independent from the corona at the tip of any other spark plug of the engine.

13. The corona device according to claim 7, wherein the corona is present when each spark plug fires.

14. A corona producing device for use in conjunction with and auxiliary to an ignition system of a fuel engine to place a continuous corona in addition to an ignition spark at the tip of the each spark plugs of the engine; comprising an ignition system housing;

an RF signal source within the ignition system housing;

a capacitive coupler attached to each spark plug wire; and a single connecting wire between each coupler and the RF signal source for producing a continuous corona at the tip of each spark plug.

15. The corona device according to claim 14, wherein the coupler forms a signal capacitive connection between the connecting wire and the spark plug wire.

16. The corona device according to claim 14, wherein the output of the high voltage generator has a continuous AC component magnetic wave with rise times capable of generating wave fronts in gases in the combustion chamber.

17. The corona device according to claim 14, wherein the RF generator provides a voltage output up to about 50 kv.

18. The corona device according to claim 14, wherein the corona is present when each spark plug fires.

19. An RF module integrated into a spark plug wire for producing a continuous corona at the tip of each spark plug of an engine; comprising:

a module including an RF generator for producing a continuous RF voltage;

a spark plug wire extending through said module; and an electrical coupler between the RF generator and the spark plug wire to apply the continuous RF voltage to the spark plug wire.

20. A method for improving the efficiency of a fuel engine having at least one spark plug and an ignition system, comprising the steps of:

producing an RF signal; and continuously applying the RF signal, in addition to a voltage produced by the ignition system, via a single wire to each spark plug wire, independent of other spark plug wires, to produce a continuous corona at the spark plug.

21. A corona producing device for a fuel engine to place a continuous corona in the combustion chamber of the engine; comprising a high voltage generator for producing a continuous AC voltage having frequency components in an RF range;

a metallic layer in the combustion chamber; and a connecting wire from the RF generator to the metallic layer for producing a continuous corona discharge in the combustion chamber.

22. Corona producing device according to claim 21, wherein the combustion chamber is enclosed by a head device which forms a part of the combustion chamber, and the metallic layer is deposited on and insulated therefrom by an insulating layer.

23. The corona producing device according to claim 21, wherein the connecting wire from the RF generator extends into the combustion chamber through an insulator in a wall of the combustion chamber.

* * * * *